US006371480B1

(12) United States Patent
Demmeler et al.

(10) Patent No.: US 6,371,480 B1
(45) Date of Patent: Apr. 16, 2002

(54) DEVICE FOR TRANSPORTING SHEET-LIKE ARTICLES

(75) Inventors: Erwin Demmeler, Memmingen; Wolfgang König, München; Norbert Beck, Neuching; Mario Mönch, Unterhaching, all of (DE)

(73) Assignee: Giesecke & Devriant GmbH (DE)

( * ) Notice: Subject to any disclaimer, the term of this patent is extended or adjusted under 35 U.S.C. 154(b) by 0 days.

(21) Appl. No.: 09/530,572

(22) PCT Filed: Aug. 17, 1999

(86) PCT No.: PCT/EP99/06026

§ 371 Date: Jun. 28, 2000

§ 102(e) Date: Jun. 28, 2000

(87) PCT Pub. No.: WO00/13995

PCT Pub. Date: Mar. 16, 2000

(30) Foreign Application Priority Data

Sep. 4, 1998 (DE) ..... 198 40 420

(51) Int. Cl.[7] ..... B65H 5/02

(52) U.S. Cl. ..... 271/272; 271/274; 271/198

(58) Field of Search ..... 271/271, 272, 271/273, 274, 198, 275; 198/721, 725, 842, 626.6

(56) References Cited

U.S. PATENT DOCUMENTS

| | | | | |
|---|---|---|---|---|
| 3,240,491 A | | 3/1966 | Buccicone | |
| 3,428,309 A | | 2/1969 | Brozo | |
| 3,863,352 A | * | 2/1975 | Peonski | |
| 3,951,257 A | * | 4/1976 | Storace et al. | 198/208 |
| 4,154,437 A | | 5/1979 | Butcheck et al. | |
| 4,190,185 A | | 2/1980 | Thate | |
| 4,204,672 A | | 5/1980 | Grivet | |
| 4,350,334 A | | 9/1982 | Quinton | |
| 4,353,541 A | | 10/1982 | Parzygnat | |
| 4,440,492 A | * | 4/1984 | Howard | 271/275 X |
| 5,060,930 A | | 10/1991 | Pilling | |
| 5,158,280 A | * | 10/1992 | Sanchez | 271/274 |
| 5,897,114 A | * | 4/1999 | Arikawa et al. | 271/272 |
| 6,170,820 B1 | * | 1/2001 | Hutson | 271/274 |

FOREIGN PATENT DOCUMENTS

| | | | |
|---|---|---|---|
| DE | 2914969 A1 | * | 4/1979 |
| DE | 2914969 | | 11/1980 |
| DE | 2857883 | | 3/1983 |
| DE | 3737855 | | 5/1989 |
| DE | 4302827 A1 | * | 1/1993 |
| DE | 4302827 | | 7/1994 |

OTHER PUBLICATIONS

Patent Abstracts of Japan, Band 1995, No. 7, Aug. 31, 1995; and JP07109046 (T. Fujinara), Apr. 25, 1995, Abstract.

* cited by examiner

*Primary Examiner*—David H. Bollinger
(74) *Attorney, Agent, or Firm*—Bacon & Thomas, PLLC

(57) ABSTRACT

A device for transporting sheetlike material is proposed wherein the material to be conveyed is always held between a conveyer belt (1) and a guide means (20) each lying against one of the opposite sides of the material (23). In order to maintain a reliable transport function even with fluctuating sheet thickness, it is provided that the run of the conveyer belt facing the material (23) is loaded elastically in the direction of the material (23) by pressure elements (14, 16).

10 Claims, 3 Drawing Sheets

DEVICE FOR TRANSPORTING SHEET-LIKE ARTICLES

This invention relates to a device for transporting sheetlike material between a conveyer belt and a guide means each lying against one of the two opposite sides of the material. Such devices are used in particular in paper conveying technology for example in printing machines, copiers, document processing machines and the like as well as in bank note processing machines.

In the field of bank note transport it is known for example from DE 43 02 827 A1 to transport bank notes between two transport belts moving equally fast and in the same direction. This transport method firstly involves an elaborate and high-maintenance belt guiding system and regularly requires a great number of belt deflection points to transfer sufficiently strong clamping power to the bank notes in order to convey them in frictional engagement. To improve adhesion between the circulating conveyer belts, DE 43 02 827 A1 proposes disposing means for causing magnetic and/or electromagnetic forces. Such an arrangement quite obviously involves considerable effort and energy consumption and moreover very quickly leads to problems of electromagnetic interference. Furthermore, one must also expect problems with the sensors used therein, in particular when used in bank note testing devices.

It is known from DE 28 57 883 C2 to convey bank notes between a transport belt and a fixed plate. Such a device has in particular the disadvantage of tending to crinkle or jam the bank notes due to the one-sidedly applied high friction on the stationary wall.

A further problem occurring with conveyance by transport belts is the undefined clamping power the belt exerts on the bank notes to be conveyed in particular when bank notes of varying thickness are conveyed at short distances one behind the other. For example, if a thin bank note is located between two clearly thicker bank notes regarded in the transport direction, a much lower frictional force is transferred to this thinner bank note than to the two adjacent thicker bank notes.

For conveying sheet material it is also known from DE 29 14 969 A1 to transport the sheet material between a row of firmly mounted rollers and a further row of spring loaded rollers. Such an arrangement has the disadvantage that the sheet material is unguided on both sides in the area between two pairs of rollers so that crinkling or jamming can easily occur.

The invention is therefore based on the problem of providing a device for transporting sheetlike material which guarantees a reliable transport function even at high conveying speeds and with fluctuating sheet thickness while being of simple structure and easy to maintain.

This problem is solved by a device according to claim 1.

The inventive solution is characterized in particular in that the sheetlike material is guided areally by the conveyer belt on the one hand, while the latter always ensures sufficient pressing force between sheet material and conveyer belt by reason of the elastic action of the pressure elements.

It is advantageous with respect to wear and energy consumption if the pressure elements are formed as pivotally mounted rollers. It is particularly suitable to use rolling bearings, which require little maintenance and are also especially cost-effective being standard parts.

For guidance and elastic bias of the pressure elements it is particularly suitable to use leaf springs since they can perform both functions with minimal effort and fitting space.

A preferred embodiment of the invention provides that the guide means is a roller train with pivotally mounted rollers. In particular if very great fluctuations in the sheet thickness of the transport material are to be expected, it is advantageous if the roller train consists of rollers elastically acted upon in the direction of the conveyer belt. This permits part of the fluctuation in thickness of the sheet material to be compensated by the motion of the pressure elements and the remaining part by the displacement of the guide means.

The pressure elements and the rollers of the roller train are preferably disposed opposite each other in pairs. Especially good guidance of the transport material is obtained if the roller train has cylindrical rollers since this results in linear clamping action on the transport material, thereby reliably maintaining the given transport direction.

An embodiment of the invention which is particularly easy to maintain and to operate provides that the conveyer belt and guide means, on the one hand, and the pressure elements, on the other hand, are each disposed in a portion of a hinged frame.

It has a supporting effect on transport safety if the device has a transport channel into which both the conveyer belt and the guide means protrude. Said transport channel preferably covers the maximum sheet format to be conveyed and ensures that disturbing influences are kept away from the transport path, especially in the area of the side edges of the sheets where there is a danger of dog ears forming.

Further advantageous features and the structure and function of the invention will result from the following description of an embodiment with reference to the drawing, in which.

Figure 1:
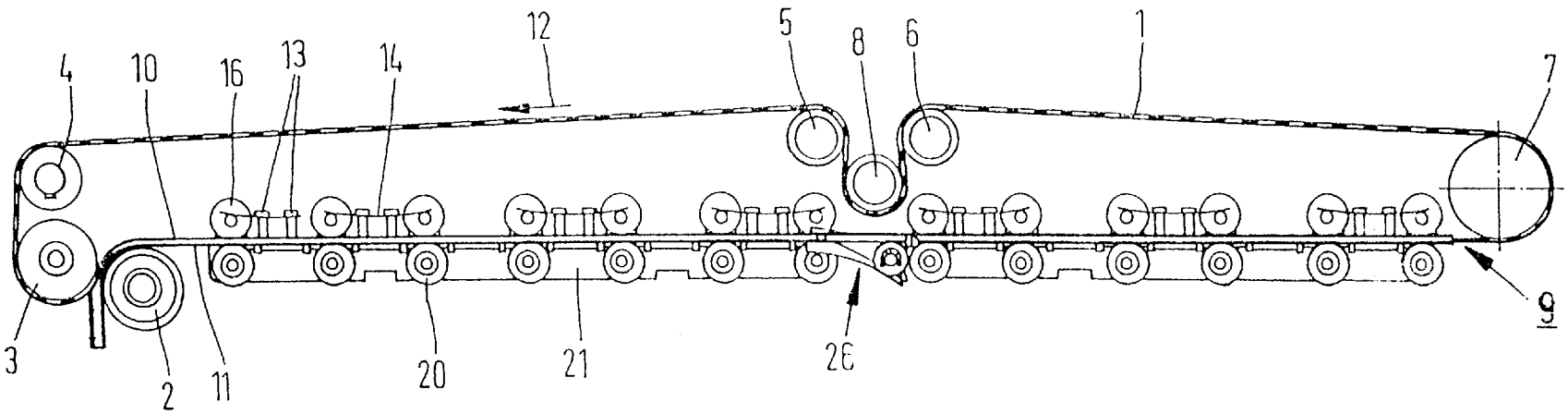
FIG. 1 shows a side view of the transport device.

FIG. 1 shows a side view of the transport path of a bank note processing machine. Particularly such applications require a high standard of safety and reliability, especially since access to the transport material itself must always be controlled due to the value of said material. Moreover, such applications involve fluctuations in the quality and also thickness of the material to be transported, resulting in extremely difficult conditions for a reliable mode of transport.

FIG. 1 shows elastic conveyer belt 1 guided around deflection rollers 2 to 6 and around drive roller 7 and tension roller 8. Tension roller 8 is mounted so as to be vertically displaceable permitting the tension in conveyer belt 1 to be adjusted by corresponding displacement. Drive roller 7 is connected with a driving motor not shown. Horizontally extending transport channel 9 is formed by two parallel walls 10 and 11. Transport channel 9 has a downward pointing arc-shaped bend between deflection rollers 2 and 3. The radius of this arc corresponds to the radius of deflection roller 2. Conveyer belt 1 extends in an S shape between deflection roller 2 acting upon the outer side of conveyer belt 1 and deflection roller 3 acting upon the inner side of the belt.

From this arc-shaped portion the bank notes to be transported are supplied to the transport device. The sense of rotation of conveyer belt 1 is indicated by arrow 12. The lower run of conveyer belt 1 extending between deflection roller 2 and drive roller 7 is located approximately in the middle between channel walls 10 and 11. Channel wall 10 is located within the area run around by transport belt 1 while channel wall 11 is located below the lower run of the belt.

Figure 2:
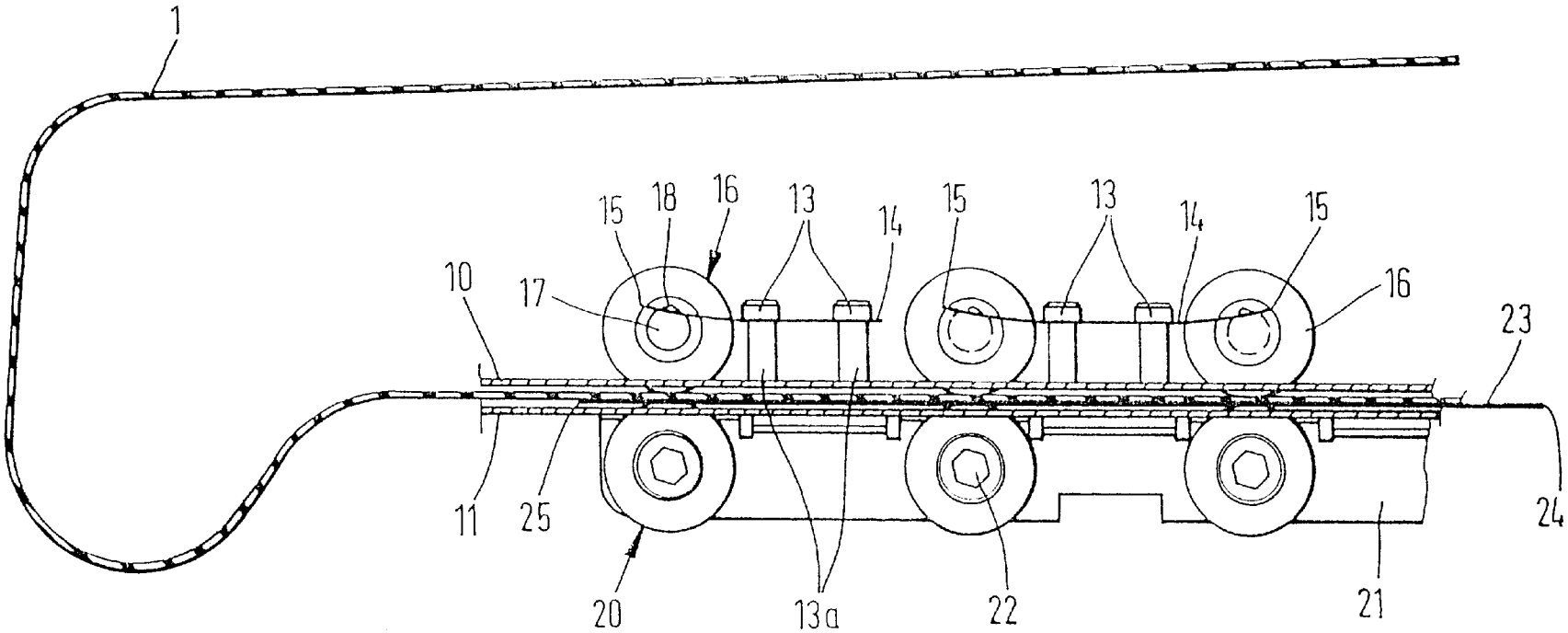
FIG. 2 shows an enlarged detail of FIG. 1.

A plurality of pairs of threaded bushes 13*a* are pressed into channel wall 10 on the side facing away from conveyer belt 1, as evident in particular from FIG. 2, each pair clamping by means of inserted screws 13 leaf spring 14 whose portions 15 facing away from supporting bolts 13 are fork-shaped. Portions 15 encompass rolling bearings 16 along the faces thereof lying biased from above on axles 17 carrying rolling bearings 16 and being connected with axle 17 by means of welding spot 18 laterally of rolling bearing 16. Rolling bearings 16 protrude partly through corresponding window-like openings 19 of the channel wall. Window-like openings 19 provided for rolling bearings 16 and the guidance of axles 17 by fork-shaped portions 15 of leaf springs 14 can be readily recognized in the view according to FIG. 4.

Disposed opposite rolling bearings 16 on the other side of conveyer belt 1 are rolling bearings 20 guided by means of a cantilever support in mounting strip 21 extending parallel to conveyer belt 1 and connected with channel wall 11 so as to form a right angle.

Figure 4:
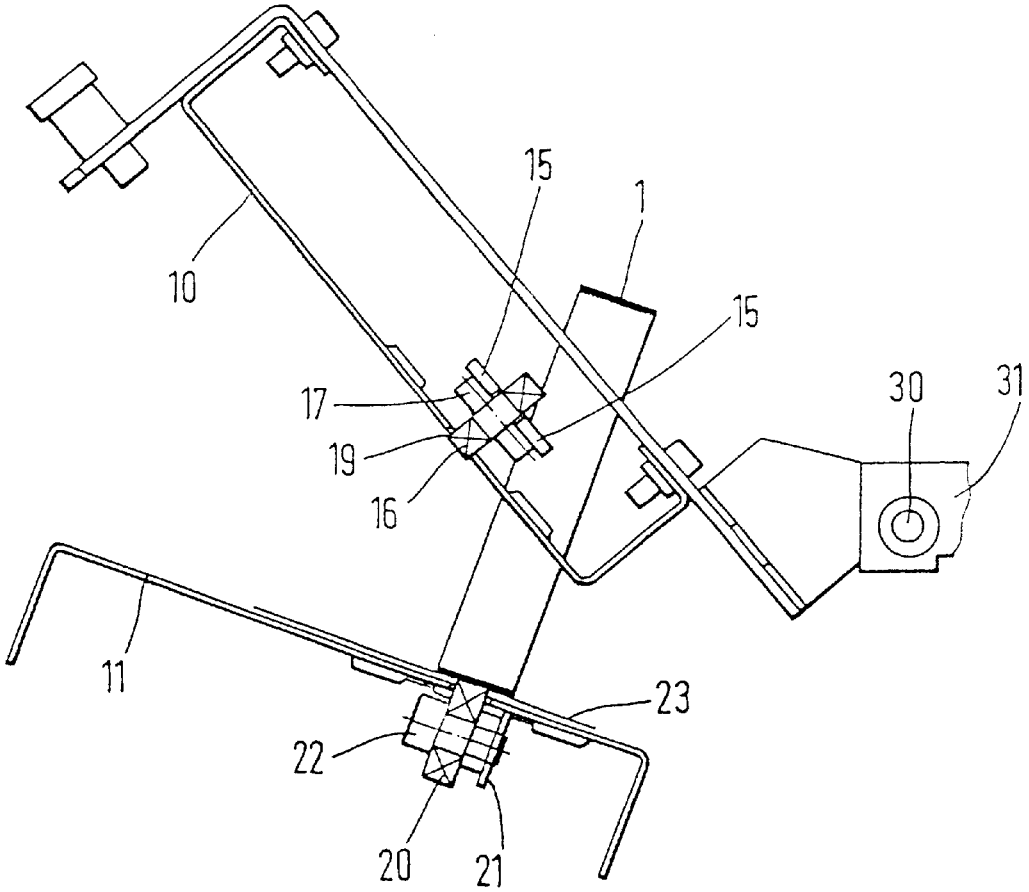
FIG. 4 shows a view of the transport device with a swung-open transport channel.

As shown in FIG. 4, rolling bearings 20 are screwed to mounting strip 21 by means of screw 22 in each case. Rolling bearings 20 also protrude into transport channel 9 through accordingly disposed window-like recesses in channel wall 11 so that conveyer belt 1 can run thereon.

Rolling bearings 16 and 20 each have a cylindrical form so as to form a nip line between them and conveyer belt I and the sheet material to be conveyed. This permits the conveyed sheet material to be guided especially reliably and prevents skew. In order to exclude external influences on transport of sheet material 23, the width of the transport channel is dimensioned such that the largest sheet format to be transported can be received completely by transport channel 9. The distance between individual pairs of rolling bearings 16 and 20 in the transport direction is dimensioned such that the transport material is always acted upon by at least two pairs of rolling bearings 16 and 20 even with the smallest sheet format to be transported. This is clearly recognizable in FIG. 2 on bank note 23 located in the transport path with leading edge 24 and trailing edge 25.

When a sheet is supplied to the transport device via the arc-shaped portion of transport channel 9 it is grasped by conveyer belt 1 and deflection roller 2, deflected by 90° in the arc and transported to the right according to FIG. 1. The first action upon or contacting of the sheet by conveyer belt 1 takes place in an area where the conveyer belt extends in an arc shape with the inner side of the arc compressed in this phase. This contact surface is aligned straight in the transport direction and the compression thus reduced in the further course of conveyance. Since the trailing end of the sheet is still located in clamped engagement between conveyer belt 1 and deflection roller 2 during the straight alignment of the conveyer belt and the sheet, a tension is transferred to the sheet thereby stretching or straightening it. During transport through transport channel 9 it comes successively into linear clamping with particular rolling bearings 20 and via conveyor belt 1 with biased rolling bearings 16. This guarantees directional stability. During transport the sheet material thus always lies areally against traveling conveyer belt 1 with one side and linearly against individual rolling bearings 20 successively.

Approximately in the middle of the transport channel there is sheet diverter 26 to permit sheet material to be transferred out of transport channel 9. The elastic action on conveyer belt 1 by biased rolling bearings 16 directly compensates differences in thickness of the material to be conveyed at each individual nip between opposite rolling bearings 16 and 20 so that reliable conveyance is given even when sheets of very different thickness are to be transported very close behind each other. In particular this prevents limp sheets from buckling or curling.

Figure 3:
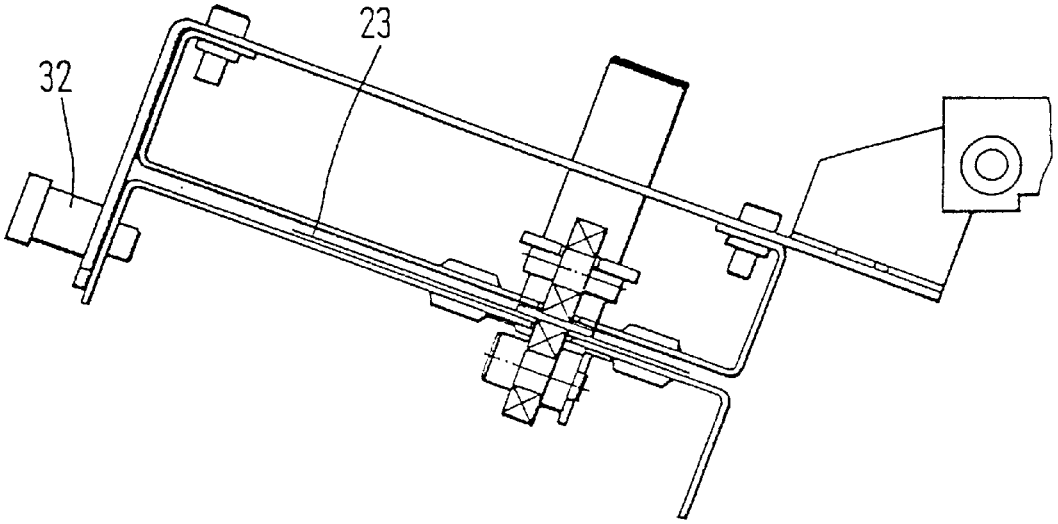
FIG. 3 shows a front view of the transport device in the direction of the longitudinal axis of the conveyer belt.

As shown in FIGS. 3 and 4, transport channel 9 can be opened very easily for purposes of maintenance, inspection or to eliminate jams, providing very good access to the whole transport path and all elements involved in conveyance. For this purpose upper channel wall 10 carrying rolling bearings 16 is pivotally attached to the basic frame 31 by joint 30, while lower channel wall 11 and the axles of deflection, drive and tension rollers 2 to 8 are connected firmly with the basic frame 31.

Upper channel wall 10 can be swiveled around joint 30 out of the home position shown in FIG. 3 after locking element 32 is undone, thereby releasing transport channel 9.

Any sheet material 23 still located in transport channel 9 is now held between conveyer belt 1 and at least two rolling bearings 20 without action by biased rolling bearings 16.

What is claimed is:

1. An apparatus having a basic frame for transporting sheetlike material (23) between a conveyer belt (1) and a guide device supported by a lower portion of said basic frame (20) each positioned and configured along one of two opposite sides of the material (23), wherein the run of the conveyor belt (1) facing the material to be conveyed (23) is loaded elastically in the direction of the material (23) by pressure elements (14, 16) carried by an upper frame portion pivotally attached to said basic frame.

2. The apparatus according to claim 1, wherein the pressure elements are formed as pivotally mounted rollers (16).

3. The apparatus according to claim 1 wherein the pressure elements are rolling bearings (16).

4. The apparatus according to claim 1 wherein the pressure elements are guided and biased by means of leaf springs (14).

5. The apparatus according to claim 1 wherein the guide device is a roller train (20).

6. The apparatus according to claim 5 wherein the roller train (20) includes rollers elastically acted upon in the direction of the conveyor belt (1).

7. The apparatus according to claim 6 wherein the pressure elements (14, 16) and the rollers of the ball train (20) are positioned opposite each other in pairs.

8. The apparatus according to claim 5 wherein the roller train includes cylindrical rollers (20).

9. The apparatus according to claim 1 wherein the device includes a transport channel (9) into which both the conveyor belt (1) and the guide device (20) protrude therein.

10. The apparatus according to claim 1 further comprising a transport channel including an upper channel wall and a lower channel wall, said upper channel wall forming a portion of said upper frame portion and said lower channel wall forming a portion of said lower frame portion, wherein axles of rollers driving and guiding said conveyor belt are connected to basic frame.

* * * * *